US011313363B2

(12) United States Patent
Marshall

(10) Patent No.: US 11,313,363 B2
(45) Date of Patent: Apr. 26, 2022

(54) PUMP ASSEMBLY WITH A ROTATIONAL TO RECIPROCAL ACTION TRANSMISSION AND A DIAPHRAGM PUMP

(71) Applicant: Brightwell Dispensers Limited, Newhaven (GB)

(72) Inventor: Andrew Timothy Marshall, Newhaven (GB)

(73) Assignee: Brightwell Dispensers Limited, Newhaven (GB)

( * ) Notice: Subject to any disclaimer, the term of this patent is extended or adjusted under 35 U.S.C. 154(b) by 200 days.

(21) Appl. No.: 16/815,668

(22) Filed: Mar. 11, 2020

(65) Prior Publication Data

US 2020/0291930 A1 Sep. 17, 2020

(30) Foreign Application Priority Data

Mar. 12, 2019 (GB) ..... 1903343

(51) Int. Cl.

| | |
|---|---|
| ***F04B 43/04*** | (2006.01) |
| ***F04B 43/00*** | (2006.01) |
| ***F04B 43/02*** | (2006.01) |
| ***F04B 53/10*** | (2006.01) |
| ***F04B 53/16*** | (2006.01) |

(52) U.S. Cl.

CPC ..... *F04B 43/04* (2013.01); *F04B 43/0009* (2013.01); *F04B 43/02* (2013.01); *F04B 53/10* (2013.01); *F04B 53/16* (2013.01)

(58) Field of Classification Search

CPC ..... F04B 43/00; F04B 43/0009; F04B 43/02; F04B 43/04; F04B 43/12; F04B 43/1207; F04B 43/14; F04B 45/047; F04B 45/08; F04B 45/085; F04B 45/10; F04B 2201/0808

USPC ..... 74/22 A, 25; 417/410.1, 412, 413.1

See application file for complete search history.

(56) References Cited

U.S. PATENT DOCUMENTS

| | | | | |
|---|---|---|---|---|
| 5,492,457 | A | 2/1996 | Lee | |
| 2002/0051717 | A1* | 5/2002 | Fukami | F04B 43/04 417/420 |
| 2010/0014998 | A1 | 1/2010 | Conner | |
| 2014/0044563 | A1* | 2/2014 | Wylie | F04B 9/02 417/38 |
| 2018/0010587 | A1* | 1/2018 | Douglas | F04B 1/148 |
| 2018/0320683 | A1 | 11/2018 | Chang | |

FOREIGN PATENT DOCUMENTS

| | | |
|---|---|---|
| CN | 2475846 | 2/2002 |
| CN | 105804961 | 7/2016 |
| CN | 207315612 | 5/2018 |
| EP | 3 285 377 | 2/2018 |
| EP | 3 418 566 | 12/2018 |
| GB | 1 224 316 | 3/1971 |
| JP | 7-83160 | 3/1995 |
| JP | 2007-291910 | 11/2007 |

* cited by examiner

*Primary Examiner* — Charles G Freay
*Assistant Examiner* — Chirag Jariwala
(74) *Attorney, Agent, or Firm* — Levy & Grandinetti

(57) ABSTRACT

A pump assembly has a motor, a gearbox, a rotational to reciprocal action transmission and a diaphragm pump, in which a shaft of the motor, an output shaft of the gearbox, a reciprocal movement axis of the transmission, and a pump shaft of the diaphragm pump are all aligned on a main axis.

18 Claims, 5 Drawing Sheets

PUMP ASSEMBLY WITH A ROTATIONAL TO RECIPROCAL ACTION TRANSMISSION AND A DIAPHRAGM PUMP

The present invention relates to a pump assembly with a rotational to reciprocal action transmission and a diaphragm pump, for use particularly, but not exclusively, to pump chemical washing fluids to industrial laundry or washing machines.

Industrial laundry or washing facilities commonly comprise a plurality of washing machines, which are provided with the required chemical washing fluids by an external delivery system. Each machine sends periodic requests for chemicals to a main dosing unit according to its programmed wash cycle, and the main dosing unit then sends instructions to one of a bank of pumps to pump an amount of concentrated chemical from a supply drum to the machine in question. The fluid pathway to the machine is controlled by valves which are opened at the appropriate time. The chemical can be delivered neat to the machine, or it can be mixed with water from a mains supply using a suitable mechanism. This kind of external delivery system provides considerable advantages over the manual loading of chemicals into each machine prior to each wash cycle.

These kinds of delivery systems commonly use peristaltic pumps comprising a rotor which acts on a resilient tube radial thereto. Such pumps are simplex, and are easy to manufacture and to use. However, they are relatively slow, and the life span of the resilient tubes is relatively short. This is not necessarily a problem with previous generations of external chemical delivery systems, which relied on banks of solenoid valves to create separate fluid pathways from pumps to the machines. However, the applicant is now envisaging a different approach with the requirement for more efficient pumping performance.

Diaphragm pumps are well known, and are used in various industries to pump fluids. They can operate at higher pressures than peristaltic pumps, but they are more complex and are usually much larger than peristaltic pumps. Part of the reason for this is that a transmission is required to convert the rotational movement of a motor shaft into a reciprocal pumping action. This is not necessary in peristaltic pumps because they employ a rotational action. The applicant intends to use diaphragm pumps in its new chemical delivery system due to the higher performance, however it is necessary to keep the size of the pumps down to a minimum. The present invention is intended to overcome this problem.

Therefore, according to the present invention a pump assembly comprises a motor, a gearbox, a rotational to reciprocal action transmission and a diaphragm pump, in which a shaft of said motor, an output shaft of said gearbox, a reciprocal movement axis of said transmission and a pump shaft of said diaphragm pump are all aligned on a main axis.

Thus, the present invention involves the use of a motor driven diaphragm pump, in which the motor, gearbox, transmission and diaphragm pump are arranged in a stack. This arrangement allows for the pump assembly as a whole to be advantageously small. However, to achieve an even more compact design a number of packaging issues need to be resolved.

In a preferred construction the output shaft of the gearbox can comprise a rotor, and the transmission can comprise a sleeve rotationally connected to the rotor and freely axially moveable relative thereto, and an annular track arranged around the sleeve. The sleeve can then comprise a plurality of radially extending arms, and the track can comprise an annular path with axially extending formations. Outer ends of the arms can be disposed on the track, and the sleeve can be axially statically connected to the pump shaft.

This transmission design is axially very short, because the track which converts the rotational movement into a reciprocal action is radially arranged around the rotor. The sleeve then travels axially back and forth over the rotor, and this reciprocal movement is transmitted to the diaphragm pump by the pump shaft which travels reciprocally with the sleeve.

A rotational bearing can be provided between the sleeve and the pump shaft, so the rotational movement of the sleeve is not transmitted to the pump shaft.

The track can comprise an upper surface and a lower surface comprising corresponding axially extending formations, such that the path is defined for the outer ends to travel along. This arrangement ensures that the arms are held securely as they rotate through the path, and it spreads the loading between the upper surface and lower surface.

Preferably the sleeve can comprise four radially extending arms. This ensures that the transmission remains balanced in use, and it also spreads the loading over a greater area. The lower surface and the upper surface can each comprise an annular sequence of four troughs, each one extending through 90 degrees of the annular path. Therefore, for each revolution of the rotor the sleeve will perform four reciprocal actions. The upper surface can be axially offset from the lower surface by 45 degrees, such that the path has a consistent depth. In other words, where the lower surface is formed as a peak the upper surface is formed as a corresponding trough, and vice versa.

In order to prevent any jamming of the outer ends of the arms in the track the four radially extending arms can comprise a first pair of 180 degree opposed arms at a first axial level relative to the sleeve, and a second pair of 180 degree opposed arms at a second axial level relative to the sleeve, which second axial level can be axially spaced from the first axial level by a clearance distance. The path between the upper surface and the lower surface can then have a height which is equal to a combination of a height of the outer ends and the clearance distance. such that the first pair of arms is in contact with the upper surface and the second pair of arms is in contact with the lower surface. This construction ensures that there is sufficient clearance at the peaks and troughs of the upper surface and lower surface to allow the outer ends of the arms to pass without jamming.

The pump can comprise an outer casing comprising a first part and a second part, in which the first part can comprise a first part of a screw thread connection on an outer surface thereof, and in which the second part can comprise a second part of the screw thread connection on an inner surface thereof. With this arrangement, the first part and the second part overlap with one another where they connect together. What this does is it eliminates any axial length being taking up by the connection between these parts. The use of a first part and a second part like this is advantageous because it allows for the pump assembly to be easily constructed and dismantled, while also allowing easy access to the components of the pump assembly in the stack. If a single casing were used, these components would have to be layered inside it.

The screw thread connection can be axially coincident with any of the components of the pump apparatus in the stack, but preferably the screw thread connection can be axially coincident with at least a portion of the transmission on the main axis. As such, disconnecting the first part and the second part exposes the transmission and the gearbox.

In one embodiment of the invention the first part can comprise a chamber for housing the gearbox and a mounting for holding the motor, and the second part can define a chamber of the diaphragm pump. Again, these features result in an advantageously axially short configuration.

The diaphragm pump can comprise a diaphragm, and a peripheral portion of the diaphragm can be sealingly secured between a first end of the first part and a shelf provided in the second part adjacent to the second part of the screw thread connection. Therefore, the diaphragm is actually held in place between the first part and the second part, meaning that the screw thread connection between the parts of the outer casing is also the means by which the diaphragm is retained for reciprocal motion. As such, the screw thread connection serves two purposes, and eliminates the need for further axial length to be taken up by separate features.

Preferably the chamber can comprise a plurality of air vents. These allow for cooling of the transmission and the gearbox.

The mounting for holding the motor can comprise a platform provided at a second end of the first part for axially supporting the motor, and a lip portion for laterally supporting the motor. Therefore, the motor is held in place on the second end of the first part, rather than being inside the first part.

The platform at the second end of the first part can comprise an aperture through which the shaft passes, and an impeller can be mounted to the shaft and can be located in the aperture. The impeller creates air flow around the motor and inside the chamber, to help cool the components in use.

In one construction the gearbox can comprise a plurality of latches which can be a snap-fit inside the chamber. This ensures that the gearbox is held securely in place relative to the motor above it, and also relative to the transmission beneath it.

The gearbox can be any known kind of gearbox which has a socket for a motor shaft, and an output shaft which are on the same axis. However, in a preferred construction the gearbox cam comprise a planetary gearbox. Planetary gearboxes are known, and their main characteristic is that their input and output shafts are arranged on the same axis. They are typical in applications in which this is beneficial, for example in power tools. In terms of their internal componentry, a planetary gearbox comprises one or more stages, each of which comprise sun gear surrounded by a plurality of planetary gears, which are surrounded by a supporting Saturn gear. As the sun gear rotates it turns the planetary gears, which then travel around the sun gear in an orbital path due to their connection with the static Saturn gear outside them. The planetary gears are mounted on a carrier, which rotates as they rotate around the sun gear. The carrier has an output on its underside. If the gearbox comprises further stages then the output forms the sun gear for the next stage. If the stage is the final one, then the output is an output shaft of the gearbox.

The use of a planetary gearbox in the pump assembly of the present invention is beneficial because it is axially short, because the gears are all normal to the main axis (the planetary gears being radial to the sun gear). Further, the input shaft and the output shaft are arranged on the main axis, allowing for the stack configuration.

The gear ratio of the planetary gearbox can be a matter for the skilled person to determine, according to the type of motor used, as well as the desired speed of the diaphragm pump. It will be appreciated that planetary gearboxes of the type used in the pump assembly of the present invention can be purchased as a unit from a manufacturer, or they could be designed and manufactured specifically for this application. Either way, there is scope for the gear ratio to be set accordingly. Further, it will also be appreciated that the motor can also be one purchased from a manufacturer, or it can be designed and manufactured specifically for this application. The rpm of the motor is a variable which will be factored into the choice or design of the planetary gearbox. In this case the applicant intends to use a known motor and a known planetary gearbox.

Furthermore, it is also possible to adjust the characteristics of the transmission in order to convert a particular speed of rotation into a desired speed of reciprocal action, or into a particular pumping capacity. This can be done by switching out the upper housing and lower housing for an alternative pair, which can have an upper surface and lower surface respectively with or a greater or smaller number of undulations, for example just two rather than four, or with a greater or lesser depth of undulations which will result in a greater or lesser axial throw of the pump shaft, and therefore the pumping capacity of the diaphragm pump.

However, in one construction the motor can be configured to run at 3,000 rpm, and the gearbox can be a two-stage planetary gearbox with a combined gear ratio of 30-1, such that the output shaft rotates at 100 rpm. This can be converted by the transmission into 400 reciprocal actions per minute of the diaphragm pump. This is suitable for the application in question.

The second part can comprise the first part of a bayonet fixing on an outer surface thereof. This is for fixing to a co-operating mount designed to support a plurality of pump assemblies.

In one construction of the invention the second part can comprise a fluid inlet aperture to which a first fluid line connector can be mounted. The first fluid line connector can have a tail section to which a supply pipe can be connected, in order to facilitate the supply of chemical fluids to the pump assembly. An inlet valve can be provided in the fluid inlet aperture, which can allow fluid to enter the diaphragm pump during a priming stroke thereof, and can prevent fluid exiting the diaphragm pump during a dispensing stroke thereof. The inlet valve can comprise a first umbrella valve comprising a first support frame with a plurality of first apertures and a first resilient umbrella valve member for closing the first apertures under positive pressure from the diaphragm pump and opening the first apertures under negative pressure from the diaphragm pump. The first support frame can be disposed between a first end of the first fluid line connector and a shelf provided in the inlet aperture. This construction is beneficial because there is no need for a separate O-ring seal between the first fluid line connector and the fluid inlet aperture, as in known devices.

A similar arrangement can be provided on the other side of the diaphragm pump. Namely, the second part can comprise a fluid outlet aperture, to which a second fluid line connector can be mounted. Again the second fluid line connector can have a tail section to which a delivery pipe can be connected, in order to facilitate the delivery of chemical fluids from the pump assembly. An outlet valve can be provided in the fluid outlet aperture, which can prevent fluid entering the diaphragm pump during the priming stroke thereof, and can allow fluid to exit the diaphragm pump during the dispensing stroke thereof. The outlet valve can comprise a second umbrella valve comprising a second support frame with a plurality of second apertures and a second resilient umbrella valve member for closing the second apertures under negative pressure from the diaphragm pump and opening the second apertures under positive pressure from the diaphragm pump. The second support frame can be disposed between a first end of the second fluid line connector and a shelf provided in the outlet aperture. Therefore, once again this is beneficial because there is no need for a separate O-ring seal between the second fluid line connector and the fluid outlet aperture, as in known devices.

The invention can be performed in various ways, but one embodiment will now be described by way of example and with reference to the accompanying drawings, in which.

Figure 1:
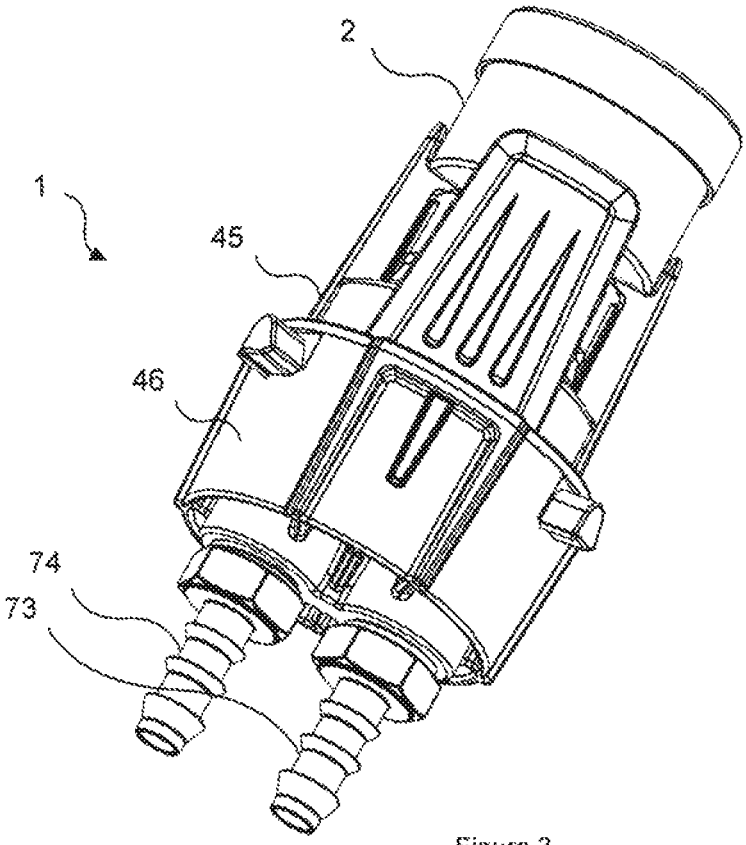
FIG. 1 is a perspective view of a pump assembly according to the present invention.

As shown in the Figures a pump assembly 1 comprises a motor 2, a gearbox 3, a rotational to reciprocal action transmission 4 and a diaphragm pump 5, in which a shaft 6 of the motor 2, an output shaft, in the form of rotor 7, of the gearbox 3, a reciprocal movement axis of the transmission 4 and a pump shaft 8 of the diaphragm pump 5 are all aligned on a main axis A-A.

Starting from the top of the stack of drive components 2-5, the motor 2 is a known standard electrical motor, which spins at 3,000 rpm. As is clear in the Figures the motor 2 is annular and axially compact. The gearbox 3 is a planetary gearbox, and the shaft 6 of the motor 2 extends down into it, with the sun gear 9 of the first stage 10 thereof at its end. As such, the shaft 6 of the motor 2 drives the sun gear 9 directly.

Figure 4:
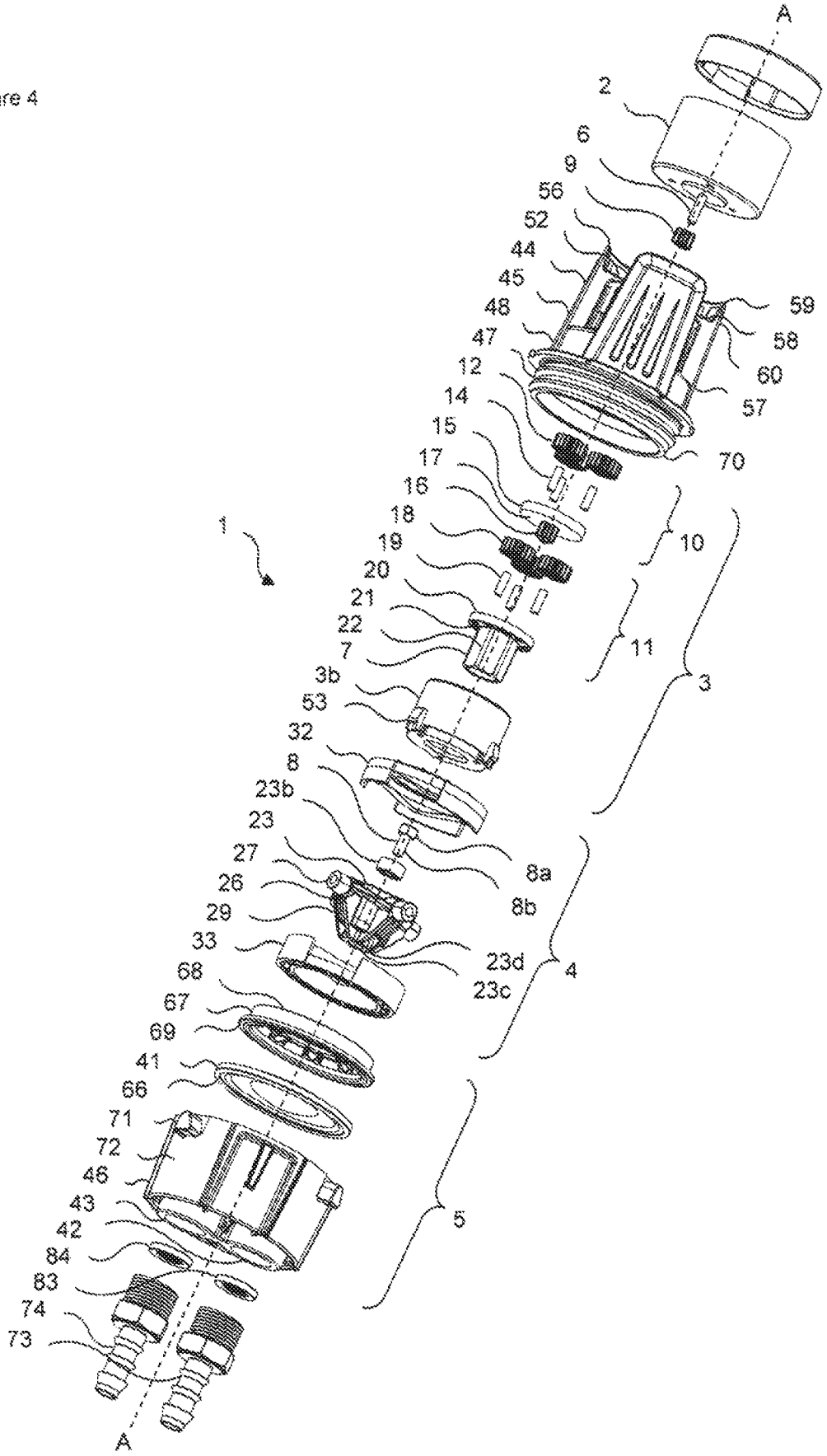
FIG. 4 is an exploded view of the pump assembly shown in FIG. 1.
Figure 7:
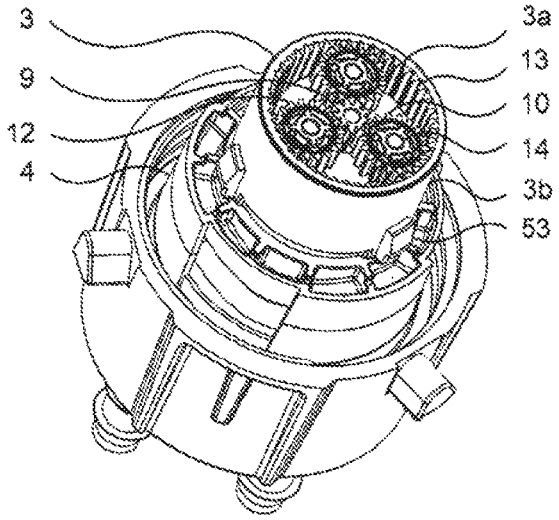
FIG. 7 is a perspective view of the pump assembly as shown in FIG. 6 with a first part of an outer casing thereof also removed.

Referring to FIG. 4, the planetary gearbox 3 comprises the first stage 10 and a second stage 11 below it. Referring to FIGS. 4 and 7, the first stage 10 comprises the sun gear 9 at its centre, with three planetary gears 12 mounted around it, which are supported by Saturn gear 13. The Saturn gear 13 is provided on an inner surface 3*a* of outer casing 3*b* of the planetary gearbox 3 (visible in FIG. 7). The planetary gears 12 are mounted on spindles 14 which are statically connected to carrier 15. The sun gear 9 comprises nine teeth, each planetary gear 12 comprises eighteen teeth, and the Saturn gear comprises forty five teeth. As the sun gear 9 rotates under drive from the motor 2, it turns the planetary gears 12, which then travel around the sun gear 9 in an orbital path due to their connection with the static Saturn 13 gear outside them. In other words, the sun gear 9 drives the planetary gears 12 along the annular Saturn gear 13. The orbital rotation of the planetary gears 12 rotates the carrier 15. The carrier's rpm is a proportion of the rpm of the sun gear 9, and is determined by the orbital rotational speed of the planetary gears 12, which is a factor of both the diameters and the numbers of teeth of the sun gear 9 and the planetary gears 12.

Referring to FIG. 4, the carrier 15 has second sun gear 16 on an underside 17 thereof, which forms a part of the second stage 11. Therefore, the sun gear 16 of the second stage 11 is driven directly by the carrier 15. Three second planetary gears 18 are mounted around the second sun gear 16, and are supported by the Saturn gear 13, which is the same along the axial length of the planetary gearbox 3. The second planetary gears 18 are mounted on second spindles 19 which are statically connected to second carrier 20. The second stage 11 is the same as the first stage 10 in that the second sun gear 16 comprises nine teeth and the second planetary gears 18 comprise eighteen teeth. Again, as the second sun gear 16 rotates under drive from the carrier 15, it turns the second planetary gears 18, which then travel around the second sun gear 9 in an orbital path due to their connection with the static Saturn 13 gear outside them. The orbital rotation of the second planetary gears 18 rotates the second carrier 20. The second carrier's rpm is a proportion of the rpm of the second sun gear 16, and is determined by the orbital rotational speed of the second planetary gears 18, which is a factor of both the diameters and the numbers of teeth of the second sun gear 16 and the second planetary gears 18.

The second carrier 20 has rotor 7 mounted on an underside 21 thereof, such that the rotor 7 is the output shaft of the planetary gearbox 3. The first stage 10 and second stage 11 of the planetary gearbox 3 have a combined gear ratio of 30-1, such that the rotor 7 rotates at 100 rpm under drive from the motor 2.

Figure 9:
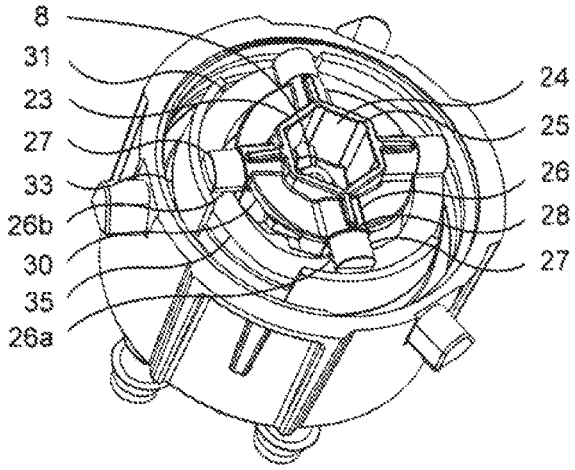
FIG. 9 is a perspective view of the pump assembly as shown in FIG. 8 with a planetary gearbox thereof also removed.

The rotor 7 is hexagonal in cross-section, and comprises ribs 22 at each outer corner. Referring to FIGS. 4 and 9, the transmission 4 comprises sleeve 23, an inner surface 24 of which has a hexagonal shape corresponding to that of the rotor 7, and has slots 25 at inner corners thereof to receive the ribs 22. This complex shape ensures that the sleeve 23 is securely rotationally static in relation to the rotor 7, and that the rotational loading applied to the sleeve 23 by the rotor 7 is spread equally around the connection between the two. However, the sleeve 23 is freely axially moveable relative to the rotor 7, such that it can move reciprocally on the main axis A-A while still being rotated by the rotation of the rotor 7.

The sleeve 23 comprises four radially extending arms 26, which are circumferentially spaced at 90 degree intervals. The arms 26 each have an annular slider 27 at an outer end 28 thereof, and as shown in FIG. 4 they also each have a lower bracing section 29 to provide axial support. Furthermore, the sleeve 23 comprises an annular skirt 30 which extends between the arms 26 to provide further support and load bearing potential.

Figure 8:
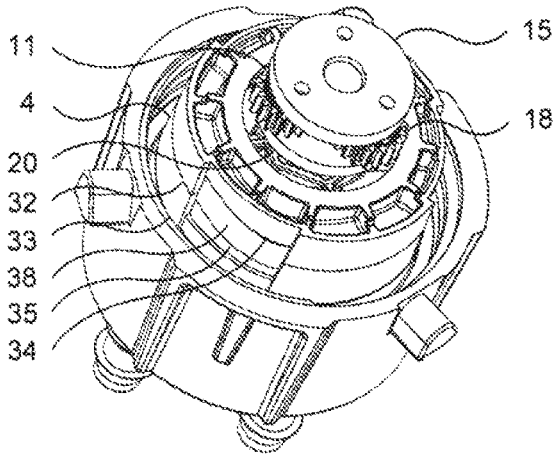
FIG. 8 is a perspective view of the pump assembly as shown in FIG. 7 with a first stage and Saturn gear of a planetary gearbox thereof also removed.
Figure 10:
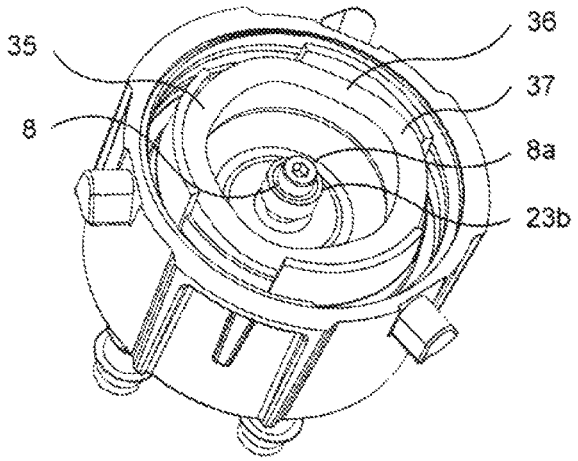
FIG. 10 is a perspective view of the pump assembly as shown in FIG. 9 with all parts of a transmission thereof, save for a lower housing, also removed.

Referring to FIGS. 8 to 10, the sliders 27 are disposed in an annular track 31 arranged around the sleeve 23. The annular track 31 is defined by an upper housing 32 and a lower housing 33 which are held together inside the pump assembly 1, as described further below. The upper housing 32 comprises an upper surface 34, and the lower housing comprises a lower surface 35, each of which comprises an annular sequence of four troughs 36, each one extending through 90 degrees, such that four peaks 37 are also formed. The upper surface 34 has the same shape but is axially offset from the lower surface 35 by 45 degrees, such that an annular path 38 is defined between the two of them which has a consistent axial depth. In other words, where the lower surface 35 is formed as a peak 37 the upper surface 34 is formed as a corresponding trough 36. Therefore, as described further below, for each 360 degree rotation of the rotor 7, the sleeve 23 performs four reciprocal actions as the sliders 27 travel on the annular track 31 along the axially undulating path 38. As such, the 100 rpm of the rotor 7 is converted by the transmission 4 into 400 reciprocal actions.

Referring to FIG. 9, the four arms 26 comprise a first pair of 180 degree opposed arms 26*a* at a first axial level relative to the sleeve 23, and a second pair of 180 degree opposed arms 26*b* at a second axial level relative to the sleeve 23, which second axial level is axially below the first axial level by a small clearance distance. It is effectively the sliders 27 of the first pair of arms 26*a* and the second pair of arms 26*b* which are axially offset from one another in this way. The path 38 has an axial depth which is equal to a combination of a height of the sliders 27 and the small clearance distance, such that sliders 27 of the first pair of arms 26*b* ride on the upper surface 34 in use and the sliders 27 of the second pair of arms 26*b* ride on the lower surface 35 in use. This construction ensures that there is sufficient clearance at the peaks 37 and troughs 36 of the upper surface 34 and lower surface 35 to allow the sliders 27 to pass without jamming. As the upper surface 34 is axially offset from the lower surface 35 by 45 degrees, the sliders 27 of the first pair of arms 26*a* reach a peak 37 on the upper surface 35 when the sliders 27 of the second pair of arms 26*b* reach the bottom of a trough 36 on the lower surface 34. Without any axial clearance gap there would be a danger of the sleeve 23 jamming in the track 31 at this point. This construction also means that the loading carried by the transmission 4 in use is divided between the first pair of arms 26*a* and the upper surface 34 on the one hand, and the second pair of arms and the lower surface 35 on the other.

Figure 5:
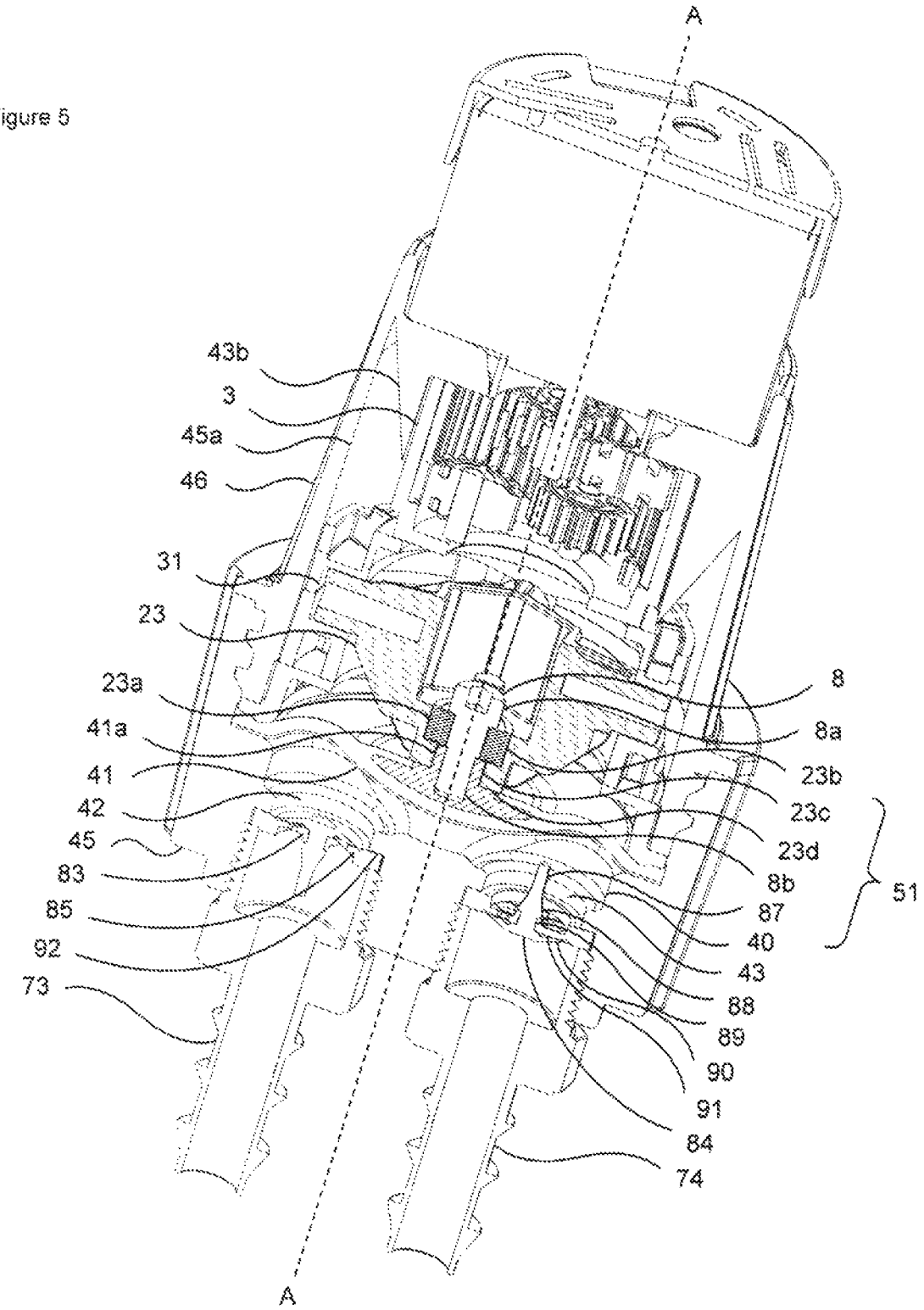
FIG. 5 is a cross-sectional perspective view of the pump assembly shown in FIG. 1.

Referring to FIG. 5, the sleeve 23 comprises an internal socket 23*a* in which is located a rotational roller bearing 23*b*. The sleeve 23 also comprises an aperture 23*c* on an underside 23*d* thereof. Located in the aperture 23*c* is an annular socket 41*a* provided at a centre of the diaphragm 41.

The roll of the pump shaft 8 is performed by a pin-like structure comprising a head section 8*a* and a tail section 8*b*. The pump shaft 8 is mounted to the inside of the sleeve 23 with the tail section 8*b* passing through the bearing 23*b* and the aperture 23*c*, such that the tail section 8*b* extends into the socket 41*a*. The tail section 8*b* is secured in the socket 41*a* by a screw thread. This axially secures the sleeve 23 to the diaphragm 41, by clamping the head section 8*a* to the bearing 23*b*, and consequently the bearing 23*b* to the socket 41*a*. However, due to the bearing 23*b* the sleeve 23 can rotate freely around the pump shaft 8 and the socket 41*a*, such that its rotational movement is not transmitted thereto. Instead, that rotational movement is carried by the bearing 23*b*.

Figure 11:
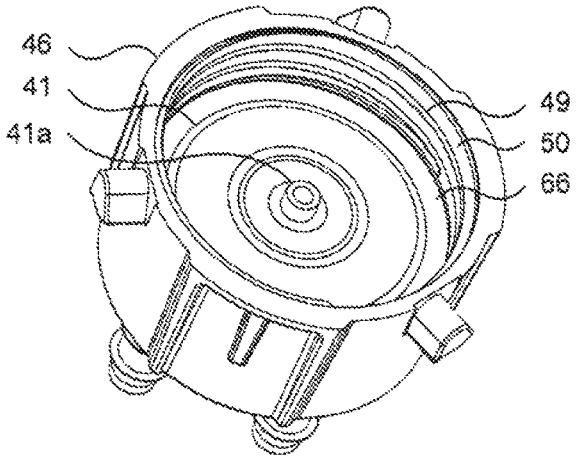
FIG. 11 is a perspective view of the pump assembly as shown in FIG. 10 with a lower housing thereof also removed.
Figure 12:
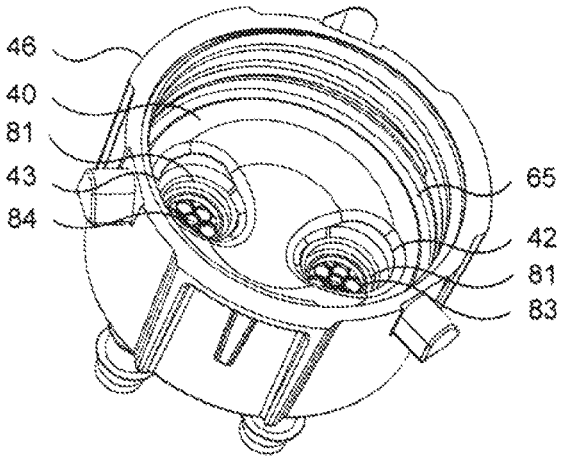
FIG. 12 is a perspective view of the pump assembly as shown in FIG. 11 with a diaphragm of a diaphragm pump thereof also removed; and, FIG. 13 is a perspective exploded view of second fluid line connector and fluid outlet valve components of the pump assembly as shown in FIG. 1.

Referring to FIGS. 5, 11 and 12, the diaphragm pump 5 comprises pump chamber 40, inside which is securely located the resilient diaphragm 41, as explained further below. The pump chamber 40 comprises a fluid inlet aperture 42 and a fluid outlet aperture 43. (In the Figures the fluid inlet aperture 42 is on the right and the fluid outlet aperture 43 is on the left, save for in FIG. 5, which depicts the pump assembly 1 from the opposite side.)

Therefore, each time the sleeve 23 travels upwardly on the main axis A-A the pump shaft 8 lifts the diaphragm 41 such that it performs a priming stroke, and fluid can be drawn into the pump chamber 40 through the fluid inlet aperture 42. Likewise, each time the sleeve 23 travels downwardly the pump shaft 8 depresses the diaphragm 41 such that it performs a dispensing stroke, and fluid can be pumped from the pump chamber 40 through the fluid outlet aperture 43.

Figure 3:
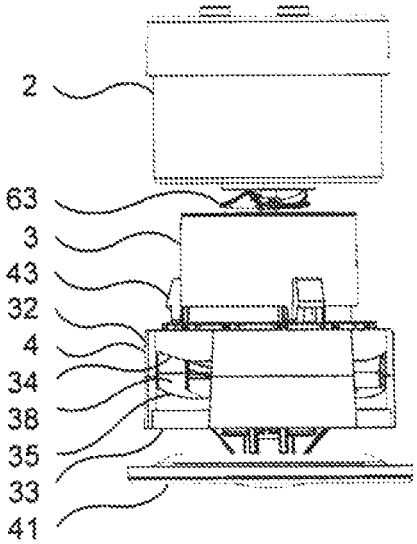
FIG. 3 is a side view of the pump assembly shown in FIG. 1, with an outer casing thereof removed.

As is clear from FIG. 3, the stack of drive components 2-5 is axially very compact. This is mainly due to the short axial length of the planetary gearbox 3, but also due to the fact that the track 31 which converts the rotational movement into a reciprocal action is radially arranged around the rotor 7 rather than being below it. Therefore the input rotation and the output reciprocation of the transmission 4 are co-axial on the main axis A-A.

Figure 2:
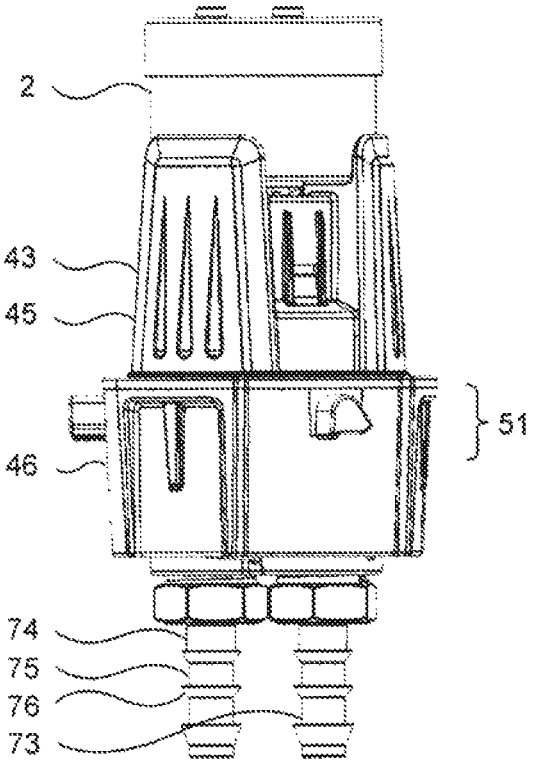
FIG. 2 is a side view of the pump assembly shown in FIG. 1.

The pump assembly 1 comprises an outer casing 44 comprising a first part 45 and a second part 46. The first part 45 comprises a first part of a screw thread connection 47 on an outer surface 48 thereof, and as shown in FIG. 11 the second part 46 comprises a second part of the screw thread connection 49 on an inner surface 50 thereof. With this arrangement the first part 45 and the second part 46 overlap with one another where they connect together. The area of axial overlap is illustrated at 51 in FIG. 2 and FIG. 5. FIGS. 2 and 3 are to scale with one another, with the components shown at the same level. As such, it can be seen that this area of overlap 51 extends internally from the diaphragm 41 to the region of the track 31.

What this overlap does is it eliminates any axial length being taking up by the connection between the first part 45 and the second part 46. The connection is radially outside the stack of drive components 2-5, and can therefore be co-axial with it. This construction of first part 45 and second part 46 is also advantageous because it allows for the pump assembly 1 to be easily constructed and dismantled, and it provides ready access to the stack of drive components 2-5. In particular, removing the first part 45 from the second part exposes the transmission 4 and the underside of the planetary gearbox 3.

The first part 45 of the outer casing 44 comprises an internal chamber 45*a*, which is visible in FIG. 5, principally for housing the planetary gearbox 3. It also has a mounting 52 for holding the motor 2. The planetary gearbox 3 comprises a plurality of latches 53 which are a snap-fit with formations 43*b* inside the internal chamber 45*a*. This ensures that the planetary gearbox 3 is held securely in place relative to the motor 2 above it, and also relative to the transmission 4 beneath it.

Figure 6:
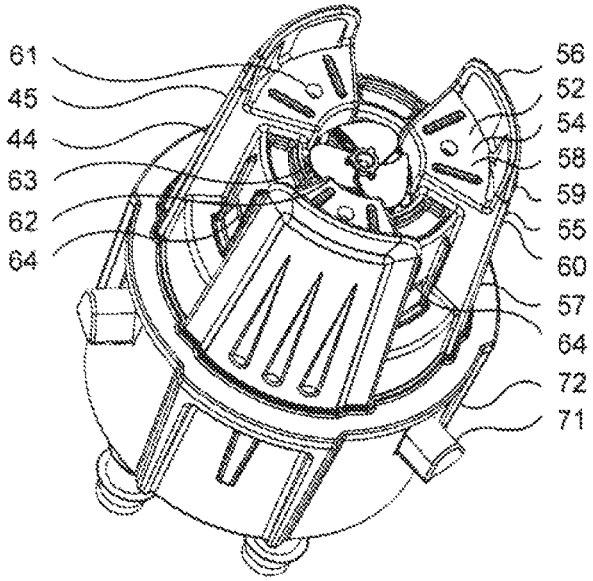
FIG. 6 is a perspective view of the pump assembly shown in FIG. 1 with a motor thereof removed.

Referring to FIG. 6, the mounting 52 for holding the motor 2 comprises a platform 54 provided at a second end 55 of the first part 45 for axially supporting the motor 2, and a lip portion 56 for laterally supporting the motor 2. The first part 45 comprises three radially extending buttress formations 57, each of which comprises a platform portion 58 and a lip portion 59 at upper ends 60 thereof. The three platform portions 58 define the platform 54, and the three part-circumferentially extending lip portions 59 defined the lip portion 56. Each platform portion 58 comprises an aperture 61 for receiving a screw to secure the motor 2 thereto. With this construction the motor 2 is held in place at the second end 55 of the first part 45 rather than being inside it. Also, the minimal physical connection between the motor 2 and the first part 45 minimises the build-up of heat in use as the motor 2 operates.

The platform 54 comprises an aperture 62 through which the shaft 6 passes in order to reach the planetary gearbox 3 inside the first part 45. As shown in FIG. 6 an impeller 63 is mounted to the shaft 6 and is located in the aperture 62. The impeller 63 creates air flow around the motor 2 and inside the internal chamber 43*a*, to help cool the components in use. Further, the first part 45 comprises a plurality of air vents 64, which facilitate such cooling air flow.

Referring to FIGS. 11 and 12, the second part 46 of the outer casing 44 defines the pump chamber 40, which is located below the second part of the screw thread connection 49. A shelf 65 is provided in the second part 46, on which a peripheral portion 66 of the diaphragm 41 is disposed. A mounting plate 67 (shown in FIG. 4) is disposed on the peripheral portion 66, which mounting plate 67 comprises a central portion 68 for supporting the lower housing 33 of the transmission 4, and a flange portion 69 for overlying the peripheral portion 66. When the first part 45 and the second part 46 of the outer casing 44 are fully screw threaded together, a first end 70 of the first part 45 is applied to the flange portion 69, thereby to sealingly secure the diaphragm 41 between the shelf 65 and the first end 70. (This arrangement of components is also clear from FIG. 5.) Therefore, the diaphragm 41 is actually held in place between the first part 45 and the second part 46, meaning that the screw thread connection between these parts of the outer casing 44 is also the means by which the diaphragm 41 is retained for reciprocal motion. As such, the screw thread connection serves two purposes, and eliminates the need for further axial length to be taken up by separate features.

In addition, the upper housing 32 and the lower housing 33 of the transmission 4 are also held together between the first part 45 and the second part 46. In particular, these parts of the transmission 4 are held between the central portion 68 of the mounting plate 67 and the outer casing 3*b* of the planetary gearbox 3. (This arrangement of components is also clear from FIG. 5.) Therefore, the screw thread connection between the first part 45 and the second part 46 also serves to affix the two opposing parts of the transmission 4 together, and therefore also takes some of the loading applied to the track 31 by the sleeve 23 in use.

The second part 46 comprises the first part of a bayonet fixing 71 on an outer surface 72 thereof. This is for fixing to a co-operating mount (not shown) designed to support a plurality of pump assemblies like pump assembly 1.

A first fluid line connector 73 is mounted to the fluid inlet aperture 42 and a second fluid line connector 74 is mounted to the fluid outlet aperture 43. The first fluid line connector 73 and the second fluid line connector 74 are identical, and each comprises a tail section 75 to which a resilient fluid hose (not shown) can be connected in order to plumb the pump assembly 1 into a chemical dispensing system. Namely, a fluid supply hose (not shown) can be connected to the first fluid line connector 73, in order to supply chemical to be pumped by the pump assembly 1, and a fluid delivery hose (not shown) can be connected to the second fluid line connector 74, in order to facilitate the delivery of chemical from the pump assembly 1. The tail sections 75 comprise three ribs 76 over which these hoses can ride when they are connected thereto, and which service to retain the hoses in place thereon.

Figure 13:
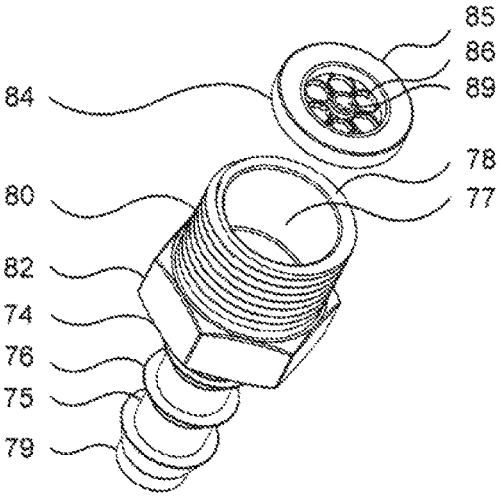

Referring to FIG. 13, which shows the second fluid line connector 74, it can be seen that it comprises a fluid pathway 77, which extends therethrough from a first end 78 thereof to a second end 79 thereof, and the first part of a screw thread connection 80. As can be seen from FIG. 12, the first inlet aperture 42 and the second inlet aperture 43 both comprises the second part of the screw thread connection 81, such that the first fluid line connector 73 and the second fluid line connector 74 can be secured in place therein respectively. The fluid line connectors 73 and 74 each comprises a nut formation 82 below the first part of the screw thread connection 80, which allows for the them to be fixed securely in the fluid inlet aperture 42 and fluid outlet aperture 43 respectively by means of a suitable tool.

A one-way inlet valve 83 is provided in the fluid inlet aperture 42, which allows fluid to enter the diaphragm pump 5 during a priming stroke thereof, and which prevents fluid exiting the fluid inlet aperture 42 during a dispensing stroke thereof. A one-way outlet valve 84 is provided in the fluid outlet aperture 43 which is identical to inlet valve 83, except it is arranged the opposite way around, such that it prevents fluid entering the diaphragm pump 5 during the priming stroke thereof, and allows fluid to exit the fluid outlet aperture 43 during the dispensing stroke thereof.

In particular, the inlet valve 83 and the outlet valve 84 are umbrella valves of the same construction. Part of the outlet valve 84 is show in an exploded view in FIG. 13, and both the inlet valve 83 and the outlet valve 84 are shown in cross-section in FIG. 5 (FIG. 5 being an opposite view to the rest of the Figures, with in the inlet valve 83 on the left.) In both cases they comprise a first support frame 85 with a plurality of apertures 86 and a first resilient umbrella valve member 87 (only shown in FIG. 5) for opening and closing the apertures 86. Referring to FIG. 5, the umbrella valve member 87 comprises a stem 88 which is mounted in central aperture 89, and an annular flange section 90 which sits in seat area 91.

In terms of inlet valve 83, the annular flange section 90 is for closing the first apertures 86 thereof under positive pressure from the diaphragm pump 5, and opening the first apertures 86 thereof under negative pressure from the diaphragm pump 5. The umbrella valve member 87 of the inlet valve 83 is resiliently biased to close the first apertures 86 thereof, but only with a force which is readily overcome by the negative pressure generated by the lifting of the diaphragm 41. In terms of outlet valve 84, the opposite is true. Namely, the annular flange section 90 is for closing the first apertures 86 thereof under negative pressure from the diaphragm pump 5, and opening the first apertures 86 thereof under negative pressure from the diaphragm pump 5. The umbrella valve member 87 of the outlet valve 84 is resiliently biased to close the first apertures 86 thereof, but only with a force which is readily overcome by the positive pressure generated by the depression of the diaphragm 41

In each case, the support frame 85 is disposed between the first end 78 of the fluid line connector 73, 74 in question and a shelf 92 provided in the fluid inlet aperture 42 and fluid outlet aperture 43 respectively. This arrangement is beneficial because there is no need for a separate O-ring seal between the fluid line connectors 73, 74 and the fluid inlet aperture 42 and fluid outlet aperture 43 respectively, as in known devices. Instead, the fluid seal is provided by the support frame 85 itself.

In use the pump assembly 1 operates as follows. The pump assembly 1 is meant to form a part of a chemical dispensing system for providing chemical washing fluids to industrial laundry or washing facilities. As part of such an installation, a mount is provided for supporting a plurality of pump assemblies like pump assembly 1. The first part of a bayonet fixing 71 is used to secure the pump assembly 1 in such a mount, with the motor 2 uppermost. A fluid supply hose (not shown) is then connected to the tail section 75 of the first fluid line connector 73, in order to supply chemical washing fluids to the pump assembly 1 from a drum, and a fluid delivery hose (not shown) is connected to the tail section 75 of the second fluid line connector 74, in order to facilitate the delivery of chemical washing fluids from the pump assembly 1 to associated laundry or washing machines. The motor 2 is then connected in the known way to a simplex I/O electronic interface (not shown) which is for receiving operational signals from a main dosing unit (not shown). The motor 2 is also connected to a power supply in the known way.

Each of the laundry or washing machines at the installation sends periodic requests for washing chemicals to the main dosing unit according to their programmed wash cycles. The main dosing unit then sends operation signals to the pump assemblies forming a part of the system, as appropriate. If the main dosing unit determines that pump assembly 1 is to operate to dispense a particular quantity of chemical washing fluid from the drum to which it is connected to one of the machines, it sends an appropriate run time instruction to the I/O interface, which then runs the motor 2 accordingly. This kind of operational communication between components of a chemical dispensing system is well known, and will not be further described here.

When the motor 2 is run it rotates the shaft at 3,000 rpm, which rotates the sun gear 9 of the first stage of the planetary gearbox 3 at the same rpm. The rotation of the sun gear 9 drives the planetary gears 12 along the Saturn gear 13, which rotates the carrier 15. As explained above the rpm of the carrier 15 is a proportion of the rpm of the sun gear 9, and is determined by the orbital rotational speed of the planetary gears 12, which is a factor of both the diameters and the numbers of teeth of the sun gear 9 and the planetary gears 12. The rotation of the carrier 15 rotates the second sun gear 16, which drives the second planetary gears 18 along the Saturn gear 13, which rotates the second carrier 20. Once again, the rpm of the second carrier is a proportion of the rpm of the second sun gear 16, and is determined by the orbital rotational speed of the second planetary gears 18, which is a factor of both the diameters and the numbers of teeth of the second sun gear 16 and the second planetary gears 18. The first stage 10 and second stage 11 of the planetary gearbox 3 have a combined gear ratio of 30-1, such that the rotor 7 mounted to the second carrier 20 rotates at 100 rpm.

The rotation of the rotor 7 rotates the sleeve 23 at the same rpm. As such the sliders 27 travel around the track 31 at 100 rpm, the sliders 27 of the first pair of arms 26*a* riding on the upper surface 34 and the sliders 27 of the second pair of arms 26*b* riding on the lower surface 35. Due to the axially undulating nature of the upper surface 34 and the lower surface 35 the sliders 27 each perform four reciprocal actions for each revolution. As such, the 100 rpm of the rotor 7 is converted by the transmission 4 into 400 reciprocal actions per minute of the sleeve 23 on the rotor 7. The sleeve 23 rotates on the bearing 23*b* and does not transmit its rotational movement to the pump shaft 8.

The axial reciprocal actions of the sleeve 23 drive the pump shaft 8 at the same rate of axial reciprocal actions. As such, the diaphragm pump 5 is driven at a speed of 400 pumping actions per minute. Each time the sleeve 23 travels upwardly on the rotor 7 the pump shaft 8 lifts the diaphragm 41 such that it flexes and performs a priming stroke. The negative pressure inside the pump chamber 40 causes the inlet valve 83 in the fluid inlet aperture 42 to open, and a volume of chemical washing fluid to be drawn into the pump chamber 40 through the fluid pathway 77 of the first fluid line connector 73, from the fluid supply hose (not shown) fitted to the tail section 75 of the first fluid line connector 73. At the same time the negative pressure causes the outlet valve 84 in the fluid outlet aperture 43 to close. At the top of the priming stroke, when the sliders 27 of the second pair of arms 26*b* are each located at a peak 37 on the lower surface 35 of the track 31, the diaphragm pump 5 is flooded with chemical washing fluid to be pumped.

As soon as the sleeve 23 rotates further and the sliders 27 all begin to fall into the next trough 36 on the lower surface 35 of the track 31, the pump shaft 8 depresses the diaphragm 41 such that it flexes and performs its dispensing stroke. The positive pressure generated in the pump chamber 40 causes the inlet vale 83 to close, and the outlet valve 84 to open, and as such the chemical washing fluid inside the pump chamber 40 is pumped out of the outlet aperture 43, via the fluid pathway 77 of the second fluid line connector 74, into the fluid delivery hose (not shown) fitted to the tail section 75 of the second fluid line connector 74. At the bottom of the dispensing stroke, when the sliders 27 of the first pair of arms 26*a* are each located at a peak 37 on the upper surface 34 of the track 31, the diaphragm pump 5 is empty. As soon as the sleeve 23 rotates further and the sliders 27 all begin to rise again, the diaphragm 41 begins its next dispensing stroke, in a repeat of the above described action.

The continued reciprocal action of the diaphragm pump 5 drives the chemical washing fluid from the drum to the laundry or washing machine which requested it, via one or more valves, manifolds or dilution points, depending on the nature of the installation. The operation signal from the main dosing unit comprises a motor run time instruction which equates to a desired volume of chemical washing fluid. For example, the motor 2 may be run for 5 seconds. As such, one this period of time has elapsed the motor 2 stops and the pump assembly 1 falls still, until such time as it is instructed to run once again. There are various known ways to refine the exact run time requirements for pumps forming a part of chemical dispensing systems, such as using flow sensors either inside or downstream of pumps to measure the actual rather than designed pumping performance, and then using processors either in the main dosing unit or local to the pumps to increase or decrease the run times accordingly, in order to ensure that the correct quantity of washing fluid is delivered. Such control systems and mechanisms are already common in the field and will not be described herein in any further detail, save to point out that any of the known systems can be applied to the pump assembly 1. This would include the application of any known kind of flow sensors to the pump assembly 1, or at any point downstream thereof, which can communicate their findings to the main dosing unit via the I/O interface at the motor 2, using any known communication protocol.

Whenever the motor 2 is run the impeller 63 is rotated, which generates air flow around the motor 2 and inside the internal chamber 43*a*, to help cool the components. Air travels through the air vents 64 to facilitate this.

In the event that any of the components of the stack of drive components 2-5 requires inspection or replacement, the first part 45 of the outer casing 44 can be removed from the second part 46 by unscrewing the screw thread connection between these parts. Lifting the first part 45 away from the second part 46 removes the rotor 7 from the sleeve 43, leaving the lower half of the pump assembly 1 exposed. This allows inspection and repair of the transmission 4 and/or the diaphragm pump 5. The various parts of the transmission 4 and the diaphragm pump 5 can be removed, similar to as in the sequence illustrated in FIGS. 9 to 12.

What this allows for is the adjustment of the performance characteristics of the transmission 4. In particular, the upper housing 32 and lower housing 33 can be switched out for an alternative pair (not shown), which can have an upper surface and lower surface respectively with or a greater or smaller number of troughs, for example just two rather than four, which would halve the frequency of the diaphragm pump 5 to 200 rpm. Alternatively, or in addition to this, the upper surface and lower surface can have a greater or lesser depth of troughs, which would increase or decrease the axial throw of the pump shaft 8, and therefore the pumping capacity of the diaphragm pump 5. It will be appreciated that making such adjustments would be a simple procedure as the upper housing 32 and the lower housing 33 are not fixed to each other, or to the second part 46. The upper housing 32 can simply be lifted free once the first part 45 is removed. The sleeve 23 is connected to the diaphragm 41 by the pump shaft 8, capturing the lower housing 33 and the mounting plate 67 therebetween, but the pump shaft 8 can be readily released from the diaphragm 41 by unscrewing the tail section 8*b* from the socket 41*a*, thereby freeing the sleeve 23, lower housing 33 and mounting plate 67.

As the first part 45 is lifted free, it takes the motor 2 and the planetary gearbox 3 with it. The motor 2 can be removed from the platform 54 if required, and/or the planetary gearbox 3 can be removed from the internal chamber by releasing the snap-fit connection provided by the latches 53.

The pump assembly 1 can be re-assembled in a reverse of the above described procedure.

The pump assembly 1 can be altered without departing from the scope of claim 1. For example. in other alternative embodiments (not shown), the pumping performance is different due to the use of motors which run at different speeds and/or the use of planetary gearboxes with different gear ratios and/or the use of transmissions with different conversion rates and/or the use of pump chambers of different capacities. These variables are all a matter for the skilled person to determine, and are altered to suit the requirements of particular applications.

In another alternative embodiment (not shown), the first part and the second part of the outer casing are connected together with resilient clamping arms. In another alternative embodiment (not shown) the motor and the planetary gearbox are both located in the internal chamber inside the first part of the outer casing. In another alternative embodiment (not shown), the inlet valve and the outlet valve are spring loaded ball valves.

In other alternative embodiments (not shown), the gearboxes are of other constructions to planetary gearboxes, such as a regular constant mesh gearboxes or helical gearboxes and so on.

Therefore, the present invention provides a pump assembly in which the motor 2, the gearbox 3, the transmission 4 and the diaphragm pump 5 are arranged in a convenient stack, with the shaft 6, the rotor 7, the sleeve 23 and the pump shaft 8 all aligned on the main axis A-A. Further, the pump assembly 1 is axially short and compact due to a number of other novel design features, including the arrangement of the track 31 around the sleeve 23, and the arrangement of the screw thread connection between the first part 45 and the second part 46 of the outer casing 44 around the transmission 4.

The invention claimed is:

1. A pump assembly comprising: a motor, a gearbox, a rotational to reciprocal action transmission, and a diaphragm pump, in which a shaft of said motor, an output shaft of said gearbox, a reciprocal movement axis of said transmission, and a pump shaft of said diaphragm pump are all aligned on a main axis, in which said output shaft of said gearbox comprises a rotor, in which said transmission comprises a sleeve rotationally connected to said rotor and freely axially moveable relative thereto, and an annular track arranged around said sleeve, in which said sleeve comprises a plurality of radially extending arms, in which said track comprises an annular path with axially extending formations, in which outer ends of said arms are disposed on said track, and in which said sleeve is axially statically connected to said pump shaft.

2. The pump assembly as claimed in claim 1 in which said gearbox comprises a planetary gearbox.

3. The pump assembly as claimed in claim 1 in which said pump assembly comprises an outer casing comprising a first part and a second part, in which said first part comprises a first part of a screw thread connection on an outer surface thereof, and in which said second part comprises a second part of said screw thread connection on an inner surface thereof.

4. The pump assembly as claimed in claim 3 in which said second part defines a chamber of said diaphragm pump, in which said second part comprises a fluid inlet aperture, in which a first fluid line connector is mounted to said fluid inlet aperture, in which an inlet valve is provided in said fluid inlet aperture, in which said inlet valve comprises a first umbrella valve comprising a first support frame with a plurality of first apertures and a first resilient umbrella valve member for closing said first apertures under positive pressure from said diaphragm pump and opening said first apertures under negative pressure from said diaphragm pump, and in which said first support frame is disposed between a first end of said first fluid line connector and a shelf provided in said inlet aperture.

5. The pump assembly as claimed in claim 4 in which said second part comprises a fluid outlet aperture, in which a second fluid line connector is mounted to said fluid outlet aperture, in which an outlet valve is provided in said fluid outlet aperture, in which said outlet valve comprises a second umbrella valve comprising a second support frame with a plurality of second apertures and a second resilient umbrella valve member for closing said second apertures under negative pressure from said diaphragm pump and opening said second apertures under positive pressure from said diaphragm pump, and in which said second support frame is disposed between a first end of said second fluid line connector and a shelf provided in said outlet aperture.

6. The pump assembly as claimed in claim 1 in which a rotational bearing is provided between said sleeve and said pump shaft.

7. The pump assembly as claimed in claim 6 in which said track comprises an upper surface and a lower surface comprising corresponding axially extending formations such that a path is defined for said outer ends to travel along.

8. The pump assembly as claimed in claim 7 in which said sleeve comprises four radially extending arms, in which said lower surface and said upper surface each comprise an annular sequence of four troughs, each one extending through 90 degrees of said path, and in which said upper surface is axially offset from said lower surface by 45 degrees.

9. The pump assembly as claimed in claim 8 in which said four radially extending arms comprise a first pair of 180 degree opposed arms at a first axial level relative to said sleeve, and a second pair of 180 degree opposed arms at a second axial level relative to said sleeve, in which the second axial level is axially spaced from said first axial level by a clearance distance, in which said path between said upper surface and said lower surface has a height which is equal to a combination of a height of said outer ends and said clearance distance, in which said first pair of arms is in contact with said upper surface and said second pair of arms is in contact with said lower surface.

10. The pump assembly as claimed in claim 8 in which said motor is configured to run at 3,000 rpm, in which said gearbox comprises a two-stage planetary gearbox with a combined gear ratio of 30-1, such that said output shaft rotates at 100 rpm, which is converted by said transmission into 400 reciprocal actions per minute of said diaphragm pump.

11. The pump assembly as claimed in claim 3 in which said second part comprises a first part of a bayonet fixing on an outer surface thereof.

12. The pump assembly as claimed in claim 3 in which said screw thread connection is axially coincident with at least a portion of said transmission on said main axis.

13. The pump assembly as claimed in claim 12 in which said first part comprises a chamber for housing said gearbox and a mounting for holding said motor, and in which said second part defines a chamber of said diaphragm pump.

14. The pump assembly as claimed in claim 13 in which said diaphragm pump comprises a diaphragm, and in which a peripheral portion of said diaphragm is sealingly secured between a first end of said first part and a shelf provided in said second part adjacent to said second part of said screw thread connection.

15. The pump assembly as claimed in claim 14 in which said chamber comprises a plurality of air vents.

16. The pump assembly as claimed in claim 15 in which said mounting comprises a platform provided at a second end of said first part for axially supporting said motor, and a lip portion for laterally supporting said motor.

17. The pump assembly as claimed in claim 16 in which said platform comprises an aperture through which said shaft passes, and in which an impeller is mounted to said shaft and is located in said aperture.

18. The pump assembly as claimed in claim 17 in which said gearbox comprises a plurality of latches which are a snap-fit inside said chamber of the first part.

* * * * *